US007846008B2

(12) United States Patent
Bajaj

(10) Patent No.: US 7,846,008 B2
(45) Date of Patent: Dec. 7, 2010

(54) METHOD AND APPARATUS FOR IMPROVED CHEMICAL MECHANICAL PLANARIZATION AND CMP PAD

(75) Inventor: Rajeev Bajaj, Fremont, CA (US)

(73) Assignee: Semiquest Inc., San Jose, CA (US)

( * ) Notice: Subject to any disclaimer, the term of this patent is extended or adjusted under 35 U.S.C. 154(b) by 426 days.

(21) Appl. No.: 11/697,622

(22) Filed: Apr. 6, 2007

(65) Prior Publication Data

US 2008/0248734 A1 Oct. 9, 2008

Related U.S. Application Data

(63) Continuation of application No. PCT/US2005/035979, filed on Oct. 5, 2005.

(60) Provisional application No. 60/631,188, filed on Nov. 29, 2004, provisional application No. 60/639,257, filed on Dec. 27, 2004.

(51) Int. Cl.
*B24B 49/00* (2006.01)

(52) U.S. Cl. ..... 451/6; 451/527; 451/529

(58) Field of Classification Search ..... 451/6, 451/526, 527, 528, 529
See application file for complete search history.

(56) References Cited

U.S. PATENT DOCUMENTS

| | | | | |
|---|---|---|---|---|
| 5,212,910 | A | 5/1993 | Breivogel et al. | |
| 5,489,233 | A | 2/1996 | Cook et al. | |
| 5,607,346 | A | 3/1997 | Wilson et al. | |
| 5,609,517 | A * | 3/1997 | Lofaro | 451/529 |
| 5,795,218 | A * | 8/1998 | Doan et al. | 451/526 |
| 5,893,976 | A | 4/1999 | Bauer | |
| 6,019,666 | A | 2/2000 | Roberts et al. | |
| 6,024,630 | A | 2/2000 | Shendon et al. | |
| 6,089,965 | A * | 7/2000 | Otawa et al. | 451/527 |
| 6,090,475 | A | 7/2000 | Robinson et al. | |
| 6,498,101 | B1 | 12/2002 | Wang | |
| 6,612,916 | B2 | 9/2003 | Kollodge et al. | |
| 6,752,693 | B1 | 6/2004 | Kistler | |
| 6,794,605 | B2 | 9/2004 | Park et al. | |

(Continued)

FOREIGN PATENT DOCUMENTS

JP 2001071256 A 3/2001

OTHER PUBLICATIONS

Bajaj, Rajeev, PCT/US05/35978, International Search Report and Written Opinion, Mar. 15, 2006, 10pp, International Searching Authority-US, Alexandria, Virginia.

(Continued)

*Primary Examiner*—Robert Rose
(74) *Attorney, Agent, or Firm*—SNR Denton US LLP

(57) ABSTRACT

A polishing pad includes a guide plate, a porous slurry distribution layer and a flexible under-layer. Polishing elements are interdigitated with one another through the slurry distribution layer and the guide plate. The polishing elements may be affixed to the compressible under-layer and pass through corresponding holes in the guide plate so as to be maintained in a substantially vertical orientation with respect to the compressible under-layer but be translatable in a vertical direction with respect to the guide plate. Optionally, a membrane may be positioned between the guide plate and the slurry distribution layer. The polishing pad may also include wear sensors to assist in determinations of pad wear and end-of-life.

32 Claims, 10 Drawing Sheets

U.S. PATENT DOCUMENTS

| | | | |
|---|---|---|---|
| 6,962,524 | B2 | 11/2005 | Butterfield et al. |
| 6,964,604 | B2 | 11/2005 | Chen et al. |
| 6,986,705 | B2 | 1/2006 | Preston et al. |
| 6,988,942 | B2 | 1/2006 | Chen et al. |
| 7,020,306 | B2 | 3/2006 | Hirose et al. |
| 7,029,747 | B2 | 4/2006 | Huh et al. |
| 7,192,340 | B2 | 3/2007 | Ono et al. |
| 2001/0035354 | A1 | 11/2001 | Ashjaee et al. |
| 2001/0039175 | A1 | 11/2001 | Golzarian et al. |
| 2002/0173255 | A1 | 11/2002 | Shendon et al. |
| 2003/0132120 | A1 | 7/2003 | Emesh et al. |
| 2003/0153245 | A1 | 8/2003 | Talieh et al. |
| 2003/0209528 | A1 | 11/2003 | Choo et al. |
| 2003/0220053 | A1 | 11/2003 | Manens et al. |
| 2004/0110381 | A1 | 6/2004 | Yoshida |
| 2004/0163946 | A1 | 8/2004 | Chang et al. |
| 2004/0166779 | A1 | 8/2004 | Balijepalli et al. |
| 2004/0214510 | A1 | 10/2004 | So |
| 2004/0232121 | A1 | 11/2004 | Park et al. |
| 2005/0092621 | A1 | 5/2005 | Hu et al. |
| 2005/0124262 | A1 | 6/2005 | Manens |
| 2005/0159084 | A1 | 7/2005 | Basol et al. |
| 2006/0063469 | A1 | 3/2006 | Talieh et al. |
| 2006/0079159 | A1 | 4/2006 | Naujok et al. |
| 2006/0116051 | A1* | 6/2006 | Halley et al. ..... 451/6 |

OTHER PUBLICATIONS

Bajaj, Rajeev, PCT/US05/35660, International Search Report and Written Opinion, Jun. 15, 2007, 8pp, International Searching Authority-US, Alexandria, Virginia.

Bajaj, Rajeev, PCT/US05/35979 filed Oct. 5, 2005, International Search Report and Written Opinion dated Feb. 24, 2006, 8pp, WO.

Bajaj, Rajeev, PCT/US05/35732 filed Oct. 5, 2005, International Search Report and Written Opinion dated Nov. 28, 2006, 6pp, WO.

Bajaj, Rajeev; EP Application No. 05808056.5 filed Oct. 5, 2005; Extended EP Search Report; European Patent Office; Nov. 16, 2009; 4pp.

Bajaj, Rajeev; PCT/US05/35979 filed Oct. 5, 2005; International Preliminary Report on Patentability; IPEA/US; Sep. 2006; 7pp.

Bajaj, Rajeev; PCT/US05/35732 filed Oct. 5, 2005; International Preliminary Report on Patentability; WIPO; Jun. 7, 2007; 5pp.

Bajaj, Rajeev; PCT/US05/35660 filed Oct. 5, 2005; International Preliminary Report on Patentability; WIPO; Jul. 19, 2007; 6pp.

Bajaj, Rajeev; PCT/US05/35978 filed Oct. 5, 2005; International Preliminary Report on Patentability; WIPO; Jun. 7, 2007; 7pp.

* cited by examiner

METHOD AND APPARATUS FOR IMPROVED CHEMICAL MECHANICAL PLANARIZATION AND CMP PAD

RELATED APPLICATIONS

This application is a continuation of and claims priority to PCT/US05/35979, filed 5 Oct. 2005, which claims the priority benefit of and incorporates by reference U.S. Provisional Application 60/616,944, filed 6 Oct. 2004, and U.S. Provisional Application 60/639,257, filed 27 Dec. 2004; and is a Continuation-in-Part of and claims priority to PCT/US05/35732, filed 5 Oct. 2005, which claims the priority benefit of and incorporates by reference U.S. Provisional Application No. 60/631,188, filed 29 Nov. 2004, and U.S. Provisional Application No. 60/639,257, filed 27 Dec. 2004; all of which are incorporated herein by reference.

FIELD OF THE INVENTION

The present invention relates to the field of chemical mechanical planarization (CMP) and to a CMP polishing pad utilized in CMP processing, in one instance a pad having uniform or near uniform polishing performance across its surface.

BACKGROUND OF THE INVENTION

In modern integrated circuit (IC) fabrication, layers of material are applied to embedded structures previously formed on semiconductor wafers. Chemical mechanical planarization (CMP) is an abrasive process used to remove these layers and polish the surface of a wafer flat to achieve the desired structure. CMP may be performed on both oxides and metals and generally involves the use of chemical slurries applied via a polishing pad that is moved relative to the wafer (e.g., the pad may rotate circularly relative to the wafer). The resulting smooth, flat surface is necessary to maintain the photolithographic depth of focus for subsequent steps and to ensure that the metal interconnects are not deformed over contour steps. Damascene processing requires CMP to remove metals, such as tungsten or copper, from the top surface of a dielectric to define interconnect structures.

The planarization/polishing performance of a pad/slurry combination is impacted by, among other things, the mechanical properties and slurry distribution ability of the polishing pad and the chemical properties and distribution of the slurry. Often a polishing pad may be porous and/or include grooves to distribute slurry. However, this reduces the overall strength of the polishing pad, making it more flexible and thus reducing its planarization characteristic. Typically, hard (i.e., stiff) pads provide good planarization, but are associated with poor with-in wafer non-uniformity (WIWNU) film removal. Soft (i.e., flexible) pads, on the other hand, provide polishing with good WIWNU, but poor planarization. In conventional CMP systems, therefore, harder pads are often placed on top of softer pads to improve WIWNU. Nevertheless, this approach tends to degrade planarization performance when compared to use of a hard pad alone.

FIG. 1A illustrates "dishing" as a result of applying a flexible polishing pad to wafer 100. The flexible polishing pad provides for a smooth surface but creates dishing 106 by over polishing softer elements, such as copper layer 104, on the surface of substrate 102. The consequence of dishing is an undesirable loss of metal thickness, leading to poor device performance.

Dishing can be reduced or eliminated through the use of a stiffer polishing pad, which can provide greater planarization. Pads may be made stiffer by reducing the number of pores and/or grooves in the pad, however, this can lead to different consequences, for example poor slurry distribution. The net effect may be to increase the number of surface defects 108 on the substrate 102 and/or copper layer 104 (e.g., by scratching and/or pitting the surface/layer), as shown for example in FIG. 1B which illustrates surface defects 108 that may result from application of a relatively stiff polishing pad to wafer 100.

Variations in the above-effects may also be present at different points across a wafer. FIG. 1C shows a cross-section of a wafer 100' having multiple dies thereon. Assume that a copper layer is present on the top surface of wafer 100' and that FIG. 1C illustrates the wafer after CMP polishing with a hard pad has occurred. As can be seen, for those dies closer to the center of wafer, the effects of dishing 110, 114 and erosion 112, 116 are less severe than for dies near the edge of the wafer. This is due to the fact that the hard pad must compensate for WIWNU by over-polishing the dies that clear first (i.e., those near the edge of the wafer 100').

FIG. 1D illustrates the surface of a post-CMP wafer 100" after polishing with a stacked pad (i.e., one in which a hard pad is placed over a softer pad). In this instance the dishing and erosion of the features at center and edge of the wafer (110", 112" and 114", 116", respectively) is more severe than occurs near the center of the wafer 100' illustrated in FIG. 1C, but less so than occurs near the edge thereof. This is due to the fact that while the softer under-pad degrades planarization, polishing is more uniform, leading to more consistent overall performance across the entire surface of the wafer.

It is therefore the case that designing CMP polishing pads requires a trade-off between WIWNU and planarization characteristics of the pads. This trade-off has led to the development of polishing pads acceptable for processing dielectric layers (such as silicon dioxide) and metals such as tungsten (which is used for via interconnects in subtractive processing schemes). In copper processing, however, WIWNU directly impacts over-polishing (i.e., the time between complete removal of copper on any one area versus complete removal from across an entire wafer surface) and, hence, metal loss and, similarly, planarization as expressed by metal loss. This leads to variability in the metal remaining in the interconnect structures and impacts performance of the integrated circuit. It is therefore necessary that both planarity and WIWNU characteristics of a pad be optimized for best copper process performance.

Complicating the optimization process is the ever more prevalent use of low-K materials in modern integrated circuits. Such materials are mechanically fragile and, therefore, require that CMP processes use low down force (i.e., low compressive forces when the wafer is held against the pad during polishing operations). Typical down force pressures used in copper CMP are in the range of 3-5 psi, which is acceptable for processing copper—silicon dioxide interconnects and may be extendable to copper—carbon-doped silicon dioxide interconnects. Moreover, it is known that relatively high CMP down force improves WIWNU (by improving the contact between wafer and the pad). However, for semiconductor process technologies beyond 65 nm nodes (which envision the use of porous, low-K dielectric materials that are mechanically fragile and would be easily damaged by current CMP processes), the use of high down force is not a viable option. Indeed, high local stresses brought about by high down force can result in cracking of the low-K materials or even delamination of the low-K films from the wafer surface. At the same time, using low down force pressure during CMP (to achieve lower stresses) will lead to higher WIWNU, requiring longer polish times and resulting in higher metal losses. The trade-off balance discussed above must therefore take into account the presence of these low-K materials in modern semiconductor devices, and much industry attention is presently being focused on processing techniques that reduce the overall stress on the wafer surface during CMP.

Conventional polishing pads are typically made of urethanes, either in cast form and filled with micro-porous elements or from non-woven felt coated with polyurethanes. During polishing, the pad surface undergoes deformation due to polishing forces. The pad surface therefore has to be "regenerated" through a conditioning process. The conditioning process involves pressing a fine, diamond covered disc against the pad surface while the pad is rotated much like during the polishing processes. The diamonds of the conditioning disc cut through and remove the top layer of the polishing pad, thereby exposing a fresh polishing pad surface underneath.

These concepts are illustrated graphically in FIGS. 2A-2C. In particular, FIG. 2A illustrates a side cutaway view of a new polishing pad 200. Polishing pad 200 contains microelements 204 and grooves 206, much like those found in commercially available polishing pads such as the IC1000 of Rhom & Haas, Inc. FIG. 2B shows the surface 202 of polishing pad 200 after polishing. The top surface of the pad shows degradation 208, especially around the microelements 204 where the edges are degraded due to plastic or viscous flow of the bulk urethane material. FIG. 2C shows the surface 202 of the polishing pad after a conditioning process has been completed. Note the depth of grooves 206 is lower than was the case for the new pad illustrated in FIG. 2A due to material removal during conditioning.

Over multiple cycles of polishing and conditioning, it is usually the case that the overall thickness of a pad wears up to a point such that the pad needs to be replaced. It is evident to those practicing in the art that pad wear rates differ from pad to pad and may also differ from one batch of pads to another batch. Currently no quantitative method exists to determine pad wear, hence end of pad life. Instead, the end of pad life is typically based on visual inspection of the pad surface to check for remaining groove depth. In the case of an ungrooved pad, end of pad life decisions are typically based on the number of wafers polished or the time elapsed since the pad was first put in service. Because such metrics are not particularly accurate it is desirable that a consistent, quantitative means to determine "end of pad life" be implemented. That is, a method based on finite wear of the pad surface would be useful in establishing a consistent basis for pad changes.

SUMMARY OF THE INVENTION

A polishing pad configured in accordance with an embodiment of the present invention includes a guide plate having affixed thereto a porous slurry distribution layer on one side and a compressible under-layer on the other side. A plurality of polishing elements interdigitated with one another through the slurry distribution layer and the guide plate, so as to be maintained in planar orientation with respect to one other and the guide plate, are affixed to the compressible under-layer with each polishing element protruding above the surface of the guide plate to which the slurry distribution layer is adjacent. Optionally, a membrane positioned between the guide plate and the slurry distribution layer may be included. Such a membrane may be conductive or non-conductive membrane and may be fastened to the guide plate by an adhesive. In some cases, the membrane may be an ion exchange membrane.

The guide plate of the polishing pad may be made of a non-conducting material and may include holes in which individual polishing elements are accommodated. Some of the polishing elements may have circular cross sections, while others may have triangular cross sections or any other shape. In any event, the polishing elements may be made from any one or combination of: a thermally conducting material, an electrically conducting material, or a non-conducting material. For example, the polishing elements may be made of a conductive polymer polyaniline, carbon, graphite, or metal-filled polymer. One or more of the polishing elements may be fashioned so as to make sliding contact with a wafer surface, while others may be fashioned so as to make rolling contact with a wafer surface (e.g., with a rolling tip made of a polymeric, metal oxide, or electrically conducting material).

The slurry distribution material may include a number of slurry flow resistant elements (e.g., pores) and be between 10 and 90 percent porosity. Preferably, though not necessarily, the slurry distribution material is fastened to the guide plate by an adhesive. In some cases the slurry distribution material may include multiple layers of different materials. For example, the slurry distribution material may include a surface layer having relatively large pores and a lower layer having relatively small pores. It is conceivable that the slurry distribution element and guide plate functions can be performed by a single material. Such a material may be a guide plate having a open pore foam surface or grooves or baffles to modulate the slurry flow across the surface.

The polishing pad may also include wear sensors configured to provide indications of pad wear and/or end-of-life.

In a further embodiment of the present invention, a polishing pad includes a guide plate having a plurality of holes therein and being affixed to a compressible under-layer; and a plurality of polishing elements each affixed to the compressible under-layer and passing through a corresponding hole in the guide plate so as to be maintained in a substantially vertical orientation with respect to the compressible under-layer but being translatable in a vertical direction with respect to the guide plate. The polishing pad may also include a slurry distribution material fastened to the guide plate by an adhesive.

At least some of the polishing elements may have circular and/or triangular cross sections and may be made from cast or molded polyurethane, polymer materials and/or PVA. In some cases, some or all of the polishing elements may contain abrasive materials. One or more of the polishing elements may be fashioned so as to have a cylindrical body, with or without a circular base having a diameter larger than that of the cylindrical body. Some of the polishing elements may have an irregular tip or a dimpled tip. The under-layer may be made from performance polyurethane.

In various embodiments, the pad may include a pad wear sensor embedded at a depth from a top surface of the pad as measured from a working end of one or more of the polishing elements. The pad wear sensor may be an optically transparent plug having a top surface covered with reflective coating; a number of optically transparent plugs embedded to different depths within the pad; an optically transparent conical plug mounted flush with the top surface of the pad surface; an optically transparent plug having a multi-step surface configured to be exposed to varying degrees as the pad wears; or an optically transparent plug containing screens with varying degrees of transmission arranged in order of reflectivity. In still further embodiments, the pad wear sensor may be an electrochemical sensor containing two or more probes embedded in the pad, or a conductive plate embedded at a depth below the surface of the pad.

BRIEF DESCRIPTION OF THE DRAWINGS

The present invention is illustrated by way of example, and not limitation, in the figures of the accompanying drawings, in which.

DETAILED DESCRIPTION

Figure 1A:
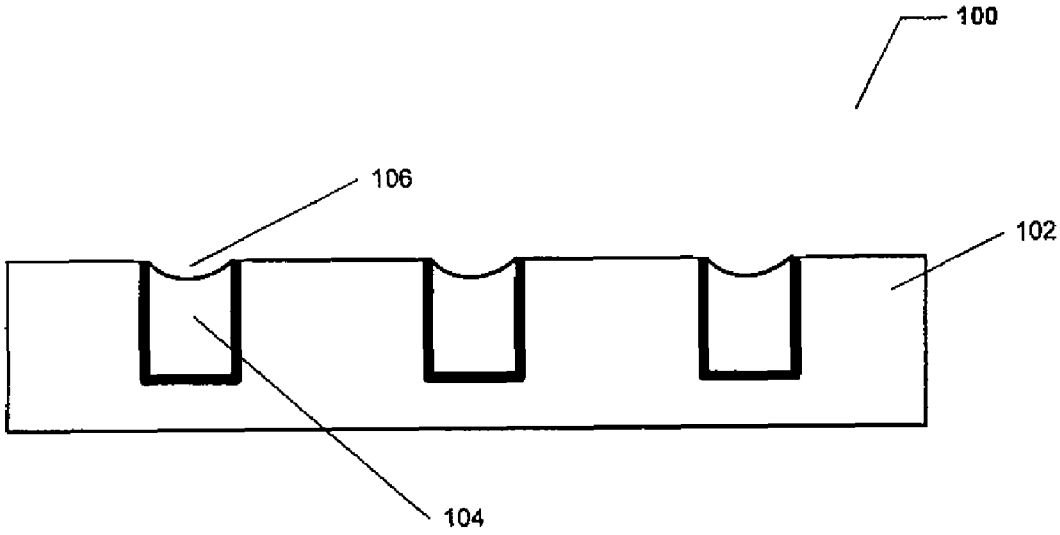
FIGS. 1A-1D illustrate the effects of dishing and erosion due to inconsistent planarization across a wafer during CMP operations.
Figure 1B:
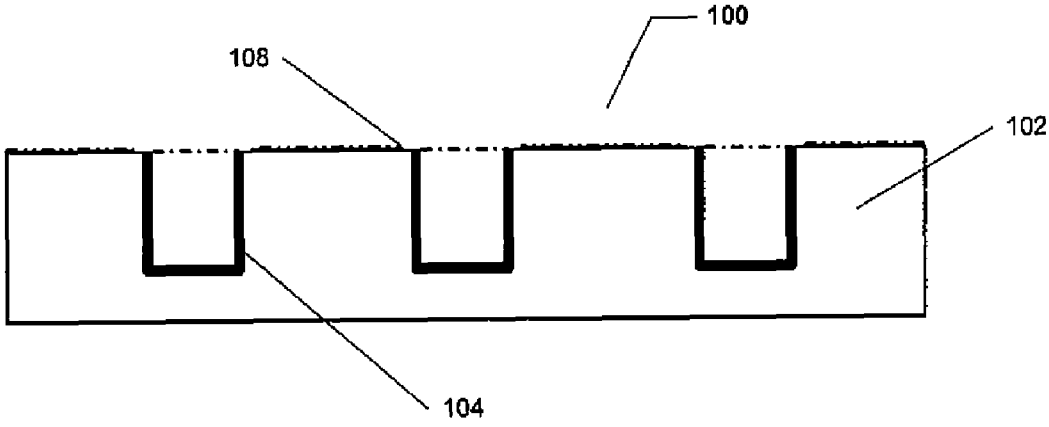
Figure 1C:
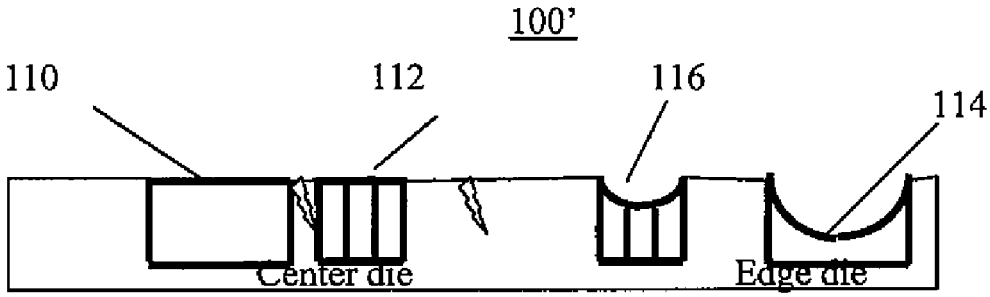
Figure 1D:
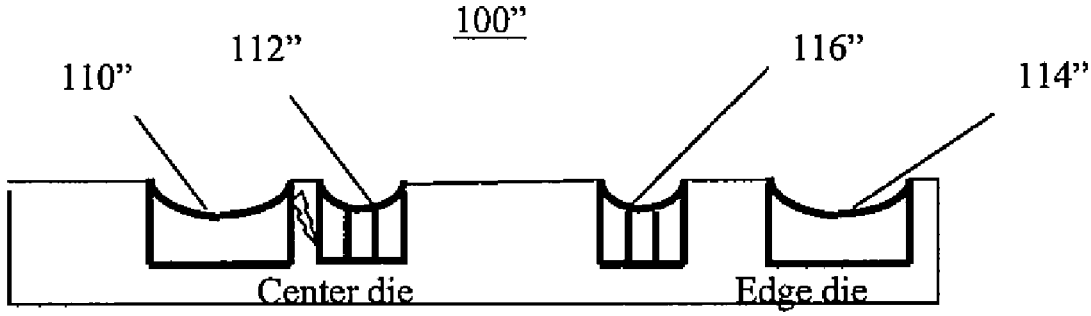
Figure 2A:
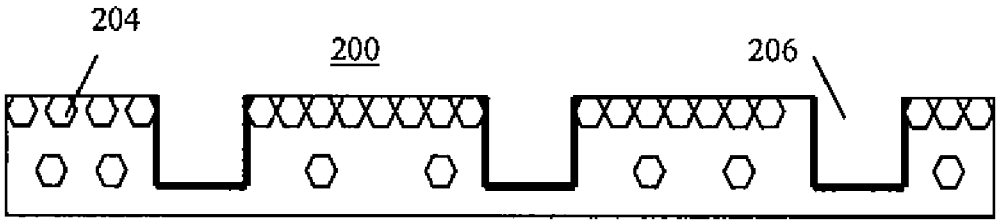
FIGS. 2A-2C illustrate concepts of pad wear experienced by conventional polishing pads.
Figure 2B:
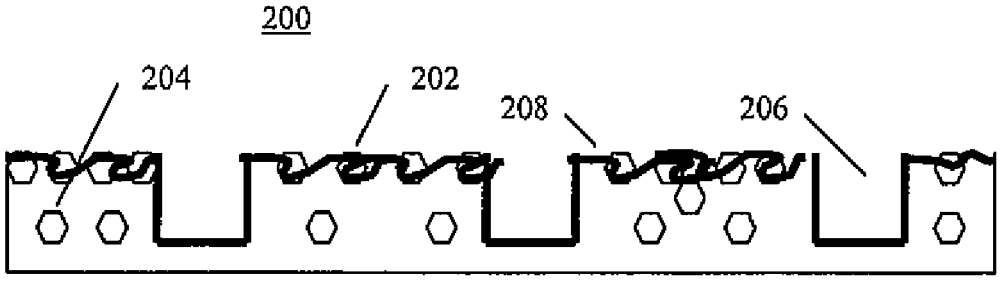
Figure 2C:
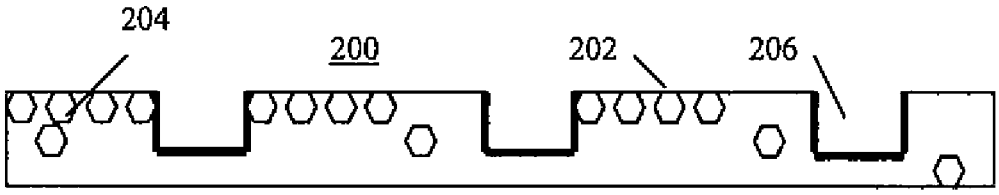

Described herein are improved CMP polishing pads and processes for polishing semiconductor wafers and structures layered thereon, including metal damascene structures on such wafers. The present invention recognizes the impact of the physical characteristics of a polishing pad in the quality of CMP processing. Specifically, it is known that a more flexible polishing pad produces dishing while a harder pad with reduced slurry distribution produces more surface defects. Although various polishing pad configurations (e.g., with specific examples of geometric ranges, ratios, and materials) and polishing processes are exemplified herein, it should be appreciated that the present invention can be equally applied to encompass other types of polishing pad fabrication materials and deposition removal techniques. Stated differently, the use of such other materials and techniques are deemed to be within the scope of the present invention as recited in the claims following this description.

Also described herein are an improved polishing pad having good planarization characteristics and being capable of providing uniform (or near uniform) pressure across a wafer during CMP operations, and a corresponding method of polishing a wafer using such a pad. In one embodiment of the present invention, the pad is placed on a polish table while a wafer is pressed against the polishing pad with a suitable down force. Slurry is applied to the pad surface while it is rotated relative to the wafer. The pad includes a slurry distribution layer disposed on a guide plate, which is itself mounted on a compressible layer. Polishing elements are mounted on the compressible layer and extend through holes in the guide plate. The polishing elements are therefore free to move in the vertical direction, independent of any neighboring elements. During polishing operations the polishing elements each apply local pressure to the wafer to achieve good planarity, while their independent functioning allows for good WIWNU.

In addition to various polishing pad configurations, the present invention includes polishing processes which involve pressing a wafer against the surface of an engineered, multi-stack polymeric pad in combination with a polishing fluid that may contain sub-micron particles and moving the wafer relative to the polishing pad under pressure so that the moving, pressurized contact results in planar removal of the surface of said wafer. A polishing pad configured in accordance with an embodiment of the invention includes various elements: a polishing fluid distribution layer, polishing contacts or elements, a guide plate, and an optional elastic, resilient (i.e., compressible) under-layer. In some cases, the various pad elements are polymeric and the polishing elements may be made of an electrically conductive material such as a conductive polymer polyaniline commercially known as Pani™ (available under trade name ORMECOM™, carbon, graphite or metal filled polymer. In other embodiments, the polishing elements may be made of a thermally conductive material, such as carbon, graphite or metal filled polymer. The slurry distribution material may be an open cell foam and the compressible under-layer a closed cell foam. The slurry distribution function may also be accomplished by providing grooves on the guide plate or creating baffles such that slurry flow is modulated.

When the pad is in use (i.e., when it is moving relative to a wafer surface), the polishing elements may make sliding contact or rolling contact with the wafer's surface. In this latter case, one or more polishing elements may have a cylindrical body and a rolling tip. The rolling tip may be made of varying materials, such as polymeric, metal oxide or an electrically conducting material. A rolling tip polishing element may be incorporated into the pad material the same way as a sliding contact polishing element.

Moreover, by providing for independent movement of the polishing elements along a vertical axis, the present polishing pad is able to apply uniform (or near uniform) pressure across the entire surface of the wafer. This unique ability eliminates "hot spots" on the wafer which might cause local material removal rate variations or, in case of low-K materials, initiate material or interface failure damage. As will be evident to those of ordinary skill in the art, this structure also ensures good WIWNU at low down forces.

In varying embodiments of the present invention, the polishing elements of the pad may be made of any suitable material such as polymer, metal, ceramic or combinations thereof, and are capable of independent or semi-independent movement in the vertical axis. The polishing elements may be of different sizes and may be positioned with varying density across the pad surface. Also in varying embodiments of the invention, a copper pad is made from elements that preferentially polish copper and is used to remove copper utilizing copper slurry. A barrier pad may be made from elements that preferentially polish barrier materials, such as Ta/TaN or other such refractory metals, and is used to remove barrier materials utilizing barrier slurry.

In still another embodiment of the invention, a copper pad is placed on one platen and barrier pad is placed on another platen to remove copper and barrier materials sequentially, utilizing separate copper and barrier slurries or a single slurry. In a further embodiment of the invention, a composite pad containing both copper and barrier removal elements is utilized to remove both copper and barrier materials on single polish platen.

The present invention recognizes the importance of individually optimizing two significant parameters in CMP performance, namely WIWNU and planarization, for low pressure processes, to be used in advanced copper polishing process. As indicated above, conventional pads used in semiconductor processing are made from cast polyurethane or are felt coated urethane materials. Typically cast urethane pads with Shore D hardness in the range of 55-75 are used for applications requiring planarization. One such hard pad, the IC1000™ made by Rhom and Haas, Inc., has a shore D hardness of 65. While such a pad provides good planarization, its WIWNU performance may not be adequate for all planarization tasks.

In an attempt to improve WIWNU performance, a hard pad is typically stacked with a softer under-pad such as the SUBA IV™ pad also made by Rhom and Haas, Inc. The softer under-pad enables the top hard pad to provide global conformation of the pad surface against the wafer. The overall rigidity of the pad stack is thus lower than the rigidity of the hard pad alone. While this may help improve WIWNU, it also causes degradation in planarization performance.

Another problem with using a hard pad for polishing is that any non-uniformity in contact between the pad and the wafer surface also leads to non-uniform local pressure, which in turn may cause the local pressure to be higher than the material or interface strength of the low K dielectric. Harder pads may therefore exhibit higher degrees of damage to the low K dielectric. While the use of a softer under-pad provides more even pressure distribution, it may not be sufficient to eliminate all local pressure variations without compromising the planarization ability of the pad stack. There is, therefore a need for polishing pad that provides good planarity with good WIWNU through improved structural design.

The present polishing pad overcomes the limitations of conventional pads by providing independently translatable polishing elements. The compliance of the polishing pad is thus decoupled from its planarization capability as well as its slurry distribution capability. Polishing elements are sized to be significantly larger than the feature scale in the circuits fashioned on the wafer, but smaller than the individual die sizes. This enables planarization at feature and array levels while providing compliance at the die and wafer levels.

A suitable material for the polishing elements of the present polishing pad is cast or molded polyurethane, such as DOW Pellethane™ 2201 65D. Other polymer materials such as Torlon™ or Delrin™ may also be used. The polishing elements may be polymeric or may contain abrasive materials such as silica or alumina. In some cases, the polishing elements may be made of PVA to provide good cleaning ability to the pad.

The compliant under-layer of the present polishing pad is selected to provide compliance of the order of wafer level bow and warpage. A suitable under-layer material may be performance polyurethane made by Rogers Corporation.

As discussed further below, a guide plate limits movement of the polishing elements to only the vertical plane (i.e., towards or away from the wafer being polished), and may be made of suitable hard plastic, ceramic or metal. In one embodiment of the present invention the guide plate is made from polycarbonate.

The polishing pads described herein may be used in a variety of steps associated with CMP processing. This includes utilization in a multi-step processes, wherein multiple polishing pads and slurries of varying characteristics are used in succession, to one step processes, where one polishing pad and one or more slurries are used throughout the entire polishing phase. Alternatively, or in addition, a pad configured with polyurethane polishing elements may be suitable for planarizing steps while a pad with polishing elements made from PVA may be suitable for buffing and cleaning steps.

In some embodiments of the present invention, the polishing pad may be configured with the capability to quantitatively determine wear of the pad's polishing surface or simply "end of pad life". For example, an "end of pad life" sensor, or more generally a "detection sensor" may be embedded in the pad at a predetermined depth from the top surface (i.e., as measured from the tip of the polishing elements). As the pad wears up to the preset thickness at which the sensor is placed or activated, the sensor detects the wear and provides input to the polishing system.

The end of life sensor may consist of an optically transparent cylindrical plug having a top surface covered with reflective coating. The plug may be embedded in the pad such that the reflective end of the plug is positioned below the top surface of the pad by a predetermined height. A light source and detector are placed in the platen of the polishing apparatus through an optically transparent window. When the light bean is incident on the plug of a new pad, the reflective surface reflects back the light indicating the pad is still within its useful life. However, when the pad has worn to a predetermined level and the top of the plug is approximately level with the now exposed pad surface, the reflective surface will be abraded away and the light will be transmitted through the pad. The resulting change in the reflected light signal intensity thus provides feedback illustrative of the pad wear. This change can be used to determine "end of pad life" (e.g., end of life may be indicated by the reflected signal intensity being at or below a previously established threshold).

The detection hardware may lie below the pad (and platen) or above the pad and that the optical insert can be appropriately modified to detect and interpret the reflected light signal. One or multiple such plugs may be used to determine percentage of remaining pad life. For example, different plugs may be embedded to different depths, corresponding to 25%, 50%, 75% and 100% (or other increments) of pad life. In this way pad wear information can be provided.

In another embodiment of the present invention a single conical plug may mounted flush with the pad surface such that the size of the plug opening exposed during pad usage provides information on the percentage of pad wear and, hence, pad life. In yet another embodiment the plug may have a multi-step surface, which is exposed to varying degrees as the pad wears. The height of the steps may be calibrated to provide information in terms of percentage of pad wear.

In still a further embodiment of the present invention, the pad life sensor plug may contain screens with varying degrees of transmission arranged in order of reflectivity. For example, the top layer may have 100% reflectivity (e.g., full reflectivity for that plug) and be flush (or nearly so) with the new pad surface. At 25% of plug depth, a screen with, say, 75% reflectivity may be embedded, and similarly at 50% of plug depth, a 50% reflectivity screen so embedded and at 75% of plug depth a 25% reflectivity screen so embedded. Of course these relative depths and reflectivity percentages may be varied to achieve similar functionality according to the designer's particular needs.

Initially with such a plug/screen arrangement, the incident beam will be completely reflected and pad life determined to be 100% (i.e., a new pad). As the pad wears, the top reflecting layer is removed and the 75% (and lower) reflectivity screens are engaged. As each such screen is exposed (and subsequently removed by further wear), the remaining pad life can be determined according to the intensity of the reflected signal. A single element can therefore be used to detect and monitor pad life.

In varying embodiments of the present invention, the sensor may be an electrochemical sensor containing two or more probes embedded in the pad at a predetermined depth or depths from the top surface of the pad when new. As the pad wears, exposing the probes, slurry provides electrical connectivity between the probes, and resulting electrical signal paths formed thereby can be used to transmit or transport signals to a detector so as to detect pad wear and, eventually, end of pad life.

In still other embodiments, the sensor may be a conductive plate embedded at a predetermined depth below the surface of a pad when new. An external capacitive or eddy current sensor may be used to detect distance from the conductive plate, hence pad thickness or pad wear. This and other embodiments of the present invention are discussed further below.

Figure 3A:
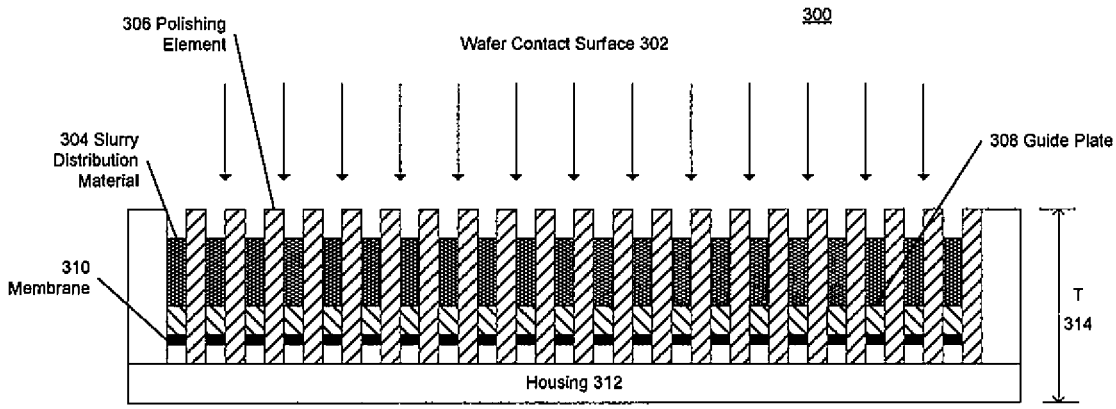
FIG. 3A is a cut-away side view of a circular polishing pad configured in accordance with one embodiment of the present invention for use in CMP operations.

Referring now to FIG. 3A, a cut-away side profile view of a circular polishing pad 300 used in CMP processing and configured according to one embodiment of the present invention is shown. As discussed further below, in this polishing pad polishing elements are placed through holes in a guide plate and supported by (e.g., affixed to) a base, such as a compressible under-layer or other housing. In use, the polishing pad 300 rotates relative to the wafer surface being polished, the surface of the polishing pad making contact with the wafer (typically under pressure) at wafer contact surface 302. A slurry distribution material 304 provides flow control in the slurry pathways between polishing elements 306.

The foundation of polishing pad is the guide plate 308, which provides lateral support for the polishing elements 306. The guide plate may be made of a non-conducting material, such as a polymeric or polycarbonate material. In one embodiment of the present invention, the guide plate 308 includes holes fabricated into or drilled out of the guide plate 308 to accommodate each of the polishing elements 306. The polishing elements 306 may be fixed to a surface other than the guide plate 308 (through which the polishing elements pass); held in place by an adhesive, such as double sided tape or epoxy. For example, the polishing elements 306 may be affixed to a flexible under-layer (discussed below) or a housing (also discussed below), but are free to move in a vertical direction with respect to their long axis, through the holes in guide plate 308.

The polishing elements may be constructed such that they have a base diameter larger than the diameter of the guide plate holes thru which they pass. For example, the body of the polishing elements may have a diameter "a" and the guide plate holes a diameter "b", such that "b" is slightly larger than "a", but nevertheless smaller than diameter "c", which is the diameter of the base of the polishing element. In essence then polishing elements will resemble a cylinder on top of a flat plate. In varying embodiments, the depth and spacing of the holes throughout the guide plate 308 may be varied according to an optimized scheme tailored to specific CMP processes. The polishing elements are each maintained in planar orientation with respect to one other and the guide plate.

The polishing elements 306 may protrude above surface of the guide plate 308, as illustrated in FIG. 3A. The polishing elements may be of varying geometric shapes (e.g., circular and/or triangular cross sections) and made from any one or combination of thermally or electrically conducting and non-conducting materials. For example, the polishing elements 306 may be made of an electrically or thermally conductive material, such as conductive polymer, polyaniline commercially known as Pani™ (trade name ORMECOM™), carbon, graphite or metal filled polymer. The polishing elements 206 may be conventional polishing elements that make sliding contact with the wafer or some or each element may include a rolling contact. For example, some or each polishing element 206 may have a cylindrical body and a rolling tip, similar to a ballpoint pen tip. The rolling tip may be a polymeric, metal oxide or electrically conducting material.

As indicated above, the volume between the interdigitated polishing elements 306 may be at least partially filled with the slurry distribution material 304. The slurry distribution material 304 may include flow resistant elements such as baffles or grooves (not shown), or pores, to regulate slurry flow rate during CMP processing. In varying embodiments, the porous slurry distribution material 304 has between 10 and 90 percent porosity and may be overlaid on guide plate 308. The slurry distribution material 304 may be fastened to the guide plate 308 by an adhesive, such as double sided tape. Additionally, the slurry distribution material 304 may be comprised of various layers of differing materials to achieve desired slurry flow rates at varying depths (from the polishing surface) of the slurry distribution material 304. For example, a surface layer at the polishing surface may have larger pores to increase the amount and rate of slurry flow on the surface while a lower layer has smaller pores to keep more slurry near the surface layer to help regulate slurry flow.

The polishing pad 300 may also include a membrane 310, located on the surface of the guide plate 308 and forming a barrier between the guide plate 308 and the slurry distribution material 304 and between each portion of the polishing elements 306 extending into the guide plate 308 and the interdigitated volume. In other cases, the membrane may be located below the guide plate 308. Membrane 310 may be a conductive or non-conductive membrane and fastened to the guide plate 308 by an adhesive, such as two-sided tape or epoxy. For example, the membrane 310 may be an ion exchange membrane that allows charge to pass but not liquid.

Polishing pad 300 may also include a housing 312, configured such that the guide plate 308, membrane 310, polishing elements 306, and slurry distribution material 304 are at least partially peripherally contained within the housing 312. The housing 312 may provide additional stability to the polishing pad 300 in addition to providing the interface to means for rotating or otherwise manipulating the pad 300 during polishing operations. The housing 312 may be made of any rigid material, such as a polymer, metal, etc., and fastened to the guide plate 308 by an adhesive, such as double sided tape or epoxy.

The thickness 314 (T) of the polishing pad 300 affects the rigidity and physical characteristics of the polish pad during use. In one embodiment, the thickness may be 25 millimeters, however, this value may vary from 3 to 10 millimeters according to the materials used in constructing the polishing pad 300 and the type of CMP process to be performed.

Figure 3B:
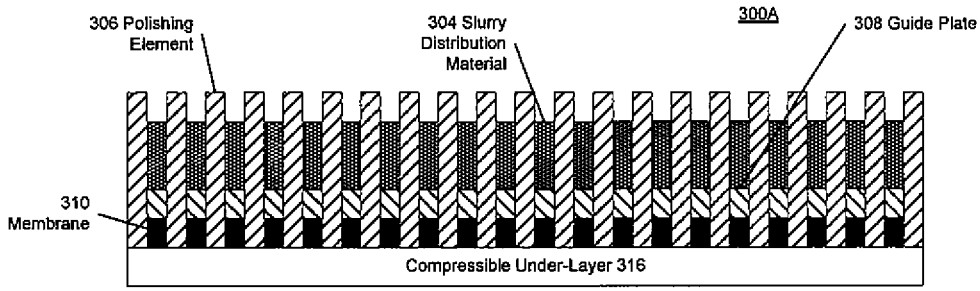
FIG. 3B illustrates a polishing pad similar to that shown in FIG. 3A, but which includes a compressible under layer in accordance with a further embodiment of the present invention.

Turning now to FIG. 3B a polishing pad 200A is shown. Pad 300A is similar in construction to pad 300 described with reference to FIG. 3A, but includes a compressible under-layer 316. The compressible under-layer 316 provides, among others features, a positive pressure directed toward the polishing surface of the pad when compressed. Typically, the compression may vary around 10% at 5 psi (pounds per square inch), however, it will be appreciated that the compression may be varied dependent upon the materials used in constructing polishing pad 300 and the type of CMP process. For example, the compressible under-layer 316 may be formed of BONDTEX™ foam made by RBX Industries, Inc. or Poron™ Performance Urethane made by Rogers Corp. In varying embodiments, the compressible under layer 316 may be contained within the housing 312, external to housing 312, or used in place of housing 312.

Figure 3C:
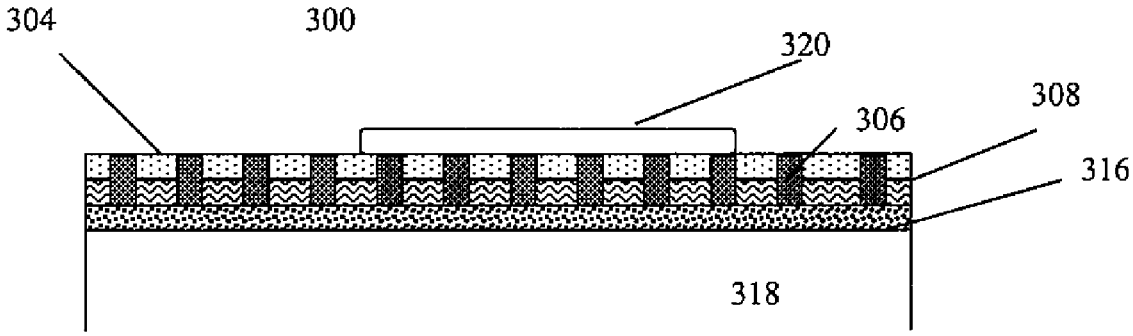
FIGS. 3C and 3D illustrate further profile views of various polishing pads configured in accordance with various embodiments of the present invention.

FIG. 3C illustrates a cut-away side profile view of polishing pad 300 as used in CMP processing, according to one embodiment of the present invention. In use, the polishing pad 300 is placed on top of the polish table 318, which rotates relative to the wafer being polished, the polishing elements of the polishing pad make contact with the wafer 320.

Figure 3D:
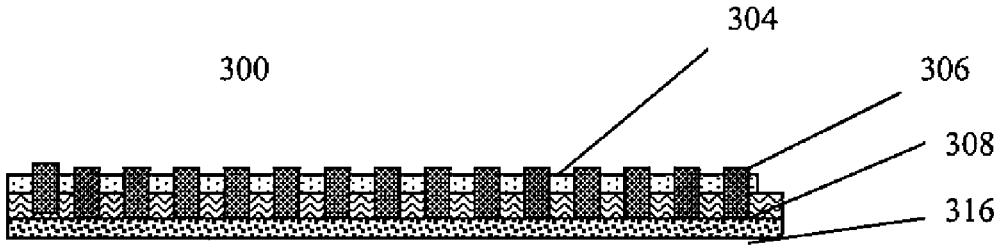

In various embodiments, see, e.g., FIG. 3D, the polishing elements 306 may protrude above the slurry distribution material 304 by, say, 2.5 millimeters or less. It will be appreciated, however, that this value may be greater than 2.5 millimeters depending on the material characteristics of the polishing elements 306 and the desired flow of slurry over the surface.

Figure 4:
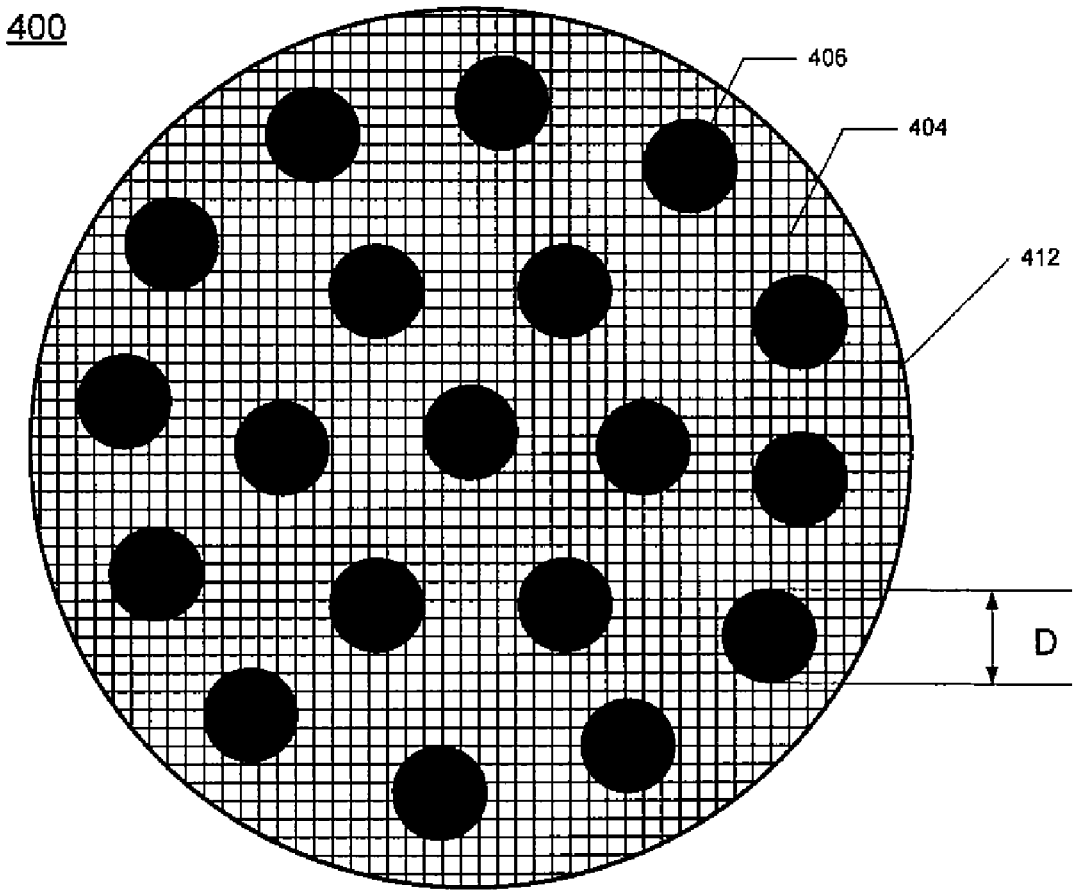
FIG. 4 is a top view of a polishing pad having interdigitated polishing elements between which slurry may flow in accordance with still another embodiment of the present invention.

FIG. 4 illustrates a top down view of a polishing pad 400, configured according to one embodiment of the present invention. Polishing elements 406 are interdigitated throughout polishing pad 400. The slurry distribution material 404 is permeated throughout the volume created by polishing elements 406 protruding from the guide plate (not shown) and enclosed by the housing 412. While the volume provides a slurry path, the slurry distribution material provides a mechanism to control slurry flow throughout the volume as discussed above.

The distribution of the polishing elements 406 may vary according to specific polishing/process requirements or characteristics. In varying embodiments, the polishing elements 406 may have a density of between 30 and 80 percent of the total polishing pad surface area, as determined by the diameter (D) of each polishing elements 406 and the diameter of the polishing pad 400. In one embodiment, the diameter D is at least 50 micrometers. In other embodiments, the diameter D may vary between 50 micrometers and 12 millimeters Typical diameters of the polishing elements are 3-10 mm.

FIGS. 5A-5D show different shapes of polishing elements that may be used in pads configured in accordance with the present invention. The polishing elements may be constructed such that they have a base diameter larger than the diameter of the guide plate holes thru which they pass. For example, the body of the polishing elements may have a diameter a and the guide plate holes a diameter "b", such that "b" is slightly larger than "a", but nevertheless smaller than diameter "c", which is the diameter of the base of the polishing element. In essence then polishing elements will resemble a cylinder on top of a flat plate. In varying embodiments, the depth and spacing of the holes throughout the guide plate may be varied according to an optimized scheme tailored to specific CMP processes. Pad element density is directly related to the material removal rate performance: the higher the pad element density, the higher the removal rate. While a uniform polishing element density pad allows a uniform removal profile, one way to modify the removal profile is to tailor the polishing element density such that a desired removal profile can be achieved. For example, to achieve an edge-fast polish rate, the density of polishing elements may increased in the area where the edge of the wafer comes in contact with the pad. Similarly, removal rates may be increased in the center of the wafer by adjusting polishing element density appropriately. The polishing elements are each maintained in planar orientation with respect to one other and the guide plate.

Figure 5A:
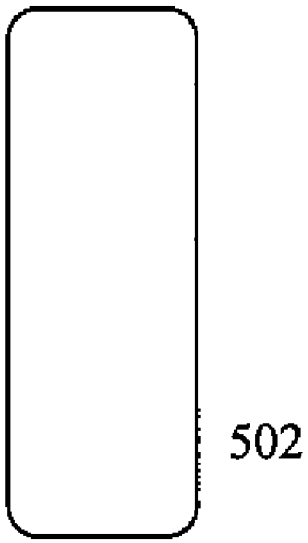
FIGS. 5A-5D illustrate various shapes of polishing elements that may be used with polishing pads configured in accordance with embodiments of the present invention.
Figure 5B:
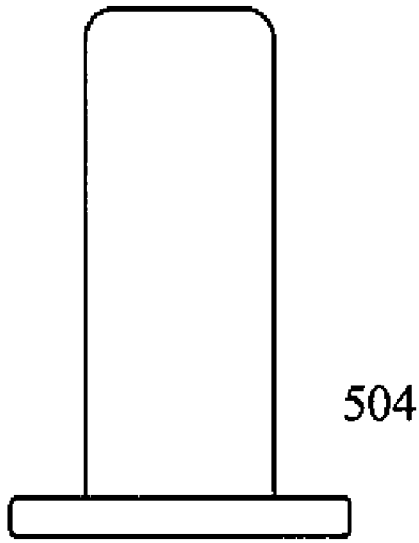
Figure 5C:
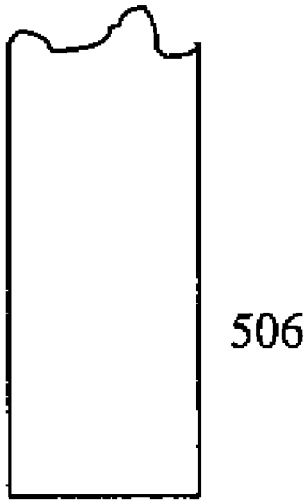
Figure 5D:
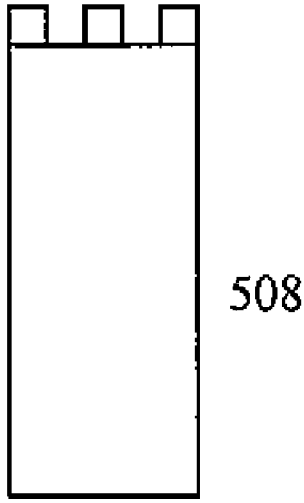

FIG. 5A shows a polishing element 502 having a generally cylindrical shape. FIG. 5B shows a polishing element 504 having a generally cylindrical body mounted on a larger circular base element. FIG. 5C shows a polishing element 506 having a generally cylindrical body with an irregularly shaped polishing tip. FIG. 5D shows a polishing element 508 having a generally cylindrical body with a dimpled polishing tip.

As indicated above, some polishing pads configured in accordance with embodiments of the present invention incorporate sensors to determine fractional or complete end of pad life (e.g., pad wear leading to end of life). Optical-, electrochemical- or current-based sensors can be used to determine such wear/end of life. The sensors are incorporated into the pad, at one or more predetermined depths below the top surface thereof. The sensors, when exposed by pad wear, enable transmission of optical signals or, in case of electrochemical sensors, electrical conductivity to close circuits, thus enabling the transmission of such signals from the sensors to one or more detectors. In case of eddy current or capacitive sensors, a conductive plate may be embedded below the top surface of the pad and the detector is placed above or below the pad. The thickness of pad between the plate and the sensor thus affects the signal strength as perceived by the detector and is used to determine fractional or complete end of pad life.

Figure 6A:
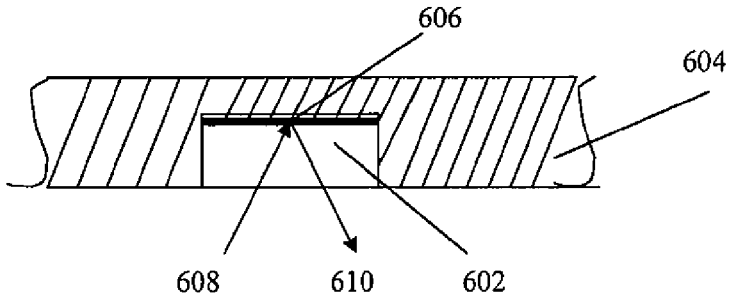
FIGS. 6A-6E show various optical sensor designs which may be used in conjunction with polishing pads configured in accordance with embodiments of the present invention.

FIG. 6A is a cut-away side profile view of an optical sensor 602 embedded in a pad 604. The top surface of the optical sensor 606 is reflective to enable incident beam 608 to be reflected 610 back, while it is below the top surface. Such sensors are useful for some embodiments of the present invention in which the polishing pad is configured with the capability to quantitatively determine wear of the pad's polishing surface or simply "end of pad life". For example, optical sensor 602 may act as an "end of pad life" sensor, or more generally a "detection sensor" embedded in the pad 604 at a predetermined depth from the top surface (i.e., as measured from the tip of the polishing elements) thereof. As the pad wears up to the preset thickness at which the sensor is placed or activated, the sensor detects the wear and provides input to the polishing system.

The sensor 602 is an optically transparent cylindrical plug having a top surface covered with reflective coating. The plug may be embedded in the pad 604 such that the reflective end of the plug is positioned below the top surface of the pad by a predetermined height. A light source and detector are placed in the platen of the polishing apparatus through an optically transparent window. When the light beam is incident on the plug of a new pad, the reflective surface reflects back the light indicating the pad is still within its useful life. However, when the pad has worn to a predetermined level and the top of the plug is approximately level with the now exposed pad surface, the reflective surface will be abraded away and the light will be transmitted through the pad. The resulting change in the reflected light signal intensity thus provides feedback illustrative of the pad wear. This change can be used to determine "end of pad life" (e.g., end of life may be indicated by the reflected signal intensity being at or below a previously established threshold).

It should be apparent that the detection hardware may lie below the pad (and platen) or above the pad and that the optical insert can be appropriately modified to detect and interpret the reflected light signal. One or multiple such plugs may be used to determine percentage of remaining pad life. For example, different plugs may be embedded to different depths, corresponding to 25%, 50%, 75% and 100% (or other increments) of pad life. In this way pad wear information can be provided.

In another embodiment of the present invention a single conical plug may mounted flush with the pad surface such that the size of the plug opening exposed during pad usage provides information on the percentage of pad wear and, hence, pad life. In yet another embodiment the plug may have a multi-step surface, which is exposed to varying degrees as the pad wears. The height of the steps may be calibrated to provide information in terms of percentage of pad wear.

In still a further embodiment of the present invention, the pad life sensor plug may contain screens with varying degrees of transmission arranged in order of reflectivity. For example, the top layer may have 100% reflectivity (e.g., full reflectivity for that plug) and be flush (or nearly so) with the new pad surface. At 25% of plug depth, a screen with, say, 75% reflectivity may be embedded, and similarly at 50% of plug depth, a 50% reflectivity screen so embedded and at 75% of plug depth a 25% reflectivity screen so embedded. Of course these relative depths and reflectivity percentages may be varied to achieve similar functionality according to the designer's particular needs.

Figure 6B:
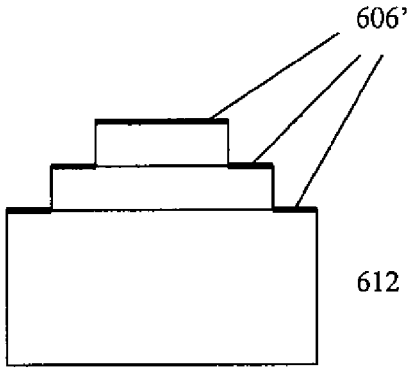
Figure 6C:
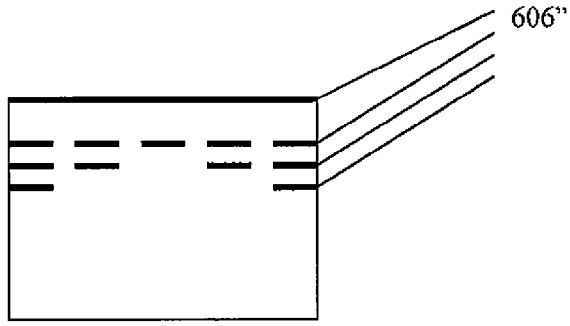
Figure 6D:
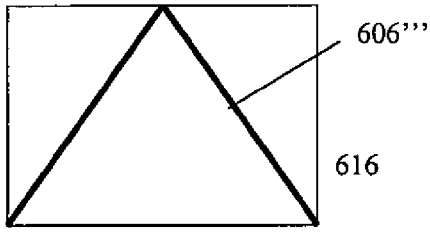
Figure 6E:
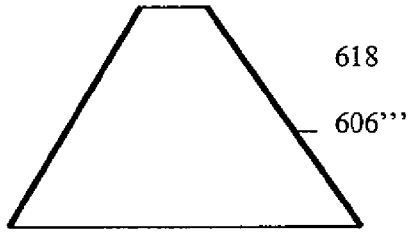

FIGS. 6B-6E show examples of the various optical sensor designs discussed above, which may be used in conjunction with a polishing pad 604 in accordance with embodiments of the present invention. Of course other configurations of optical sensors may also be used. In particular, FIG. 6B shows a multi-step optical sensor 612 with reflective surfaces 606', FIG. 6C shows a single sensor 614 with multiple reflective surfaces 606", FIG. 6D shows another means for incorporating reflecting surfaces into a single sensor. In this case the reflecting surfaces 606'" comprise sides of a triangular cross-section sensor 616. FIG. 6E shows a variable area optical sensor 618 whereby the cross-section area ratio of reflective surfaces 616, indicates the fractional pad life remaining. It should be apparent to those of ordinary skill in the art that sensors 612, 614, 616 and 618 can be incorporated in a polishing pad, flush with a top surface of the pad. Changes in reflected light signal intensity provide information on pad wear to determine end of pad life.

Figure 7A:
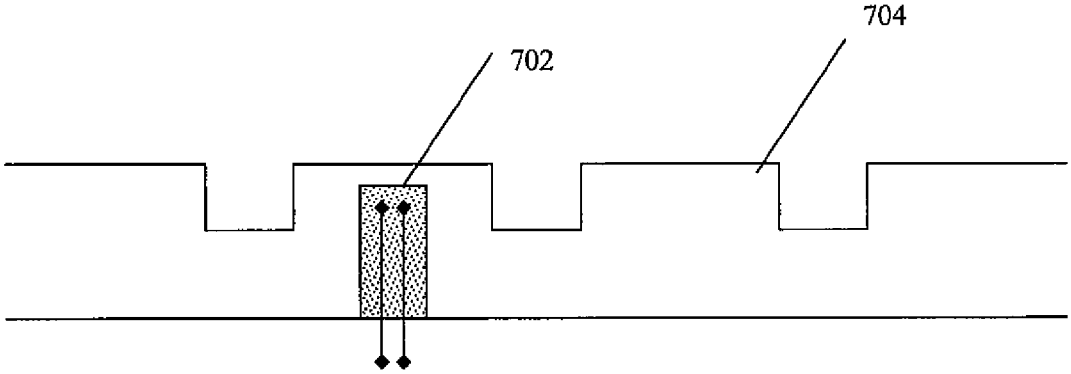
FIG. 7A illustrates an electrochemical sensor positioned below a surface of a new pad in accordance with an embodiment of the present invention.
Figure 7B:
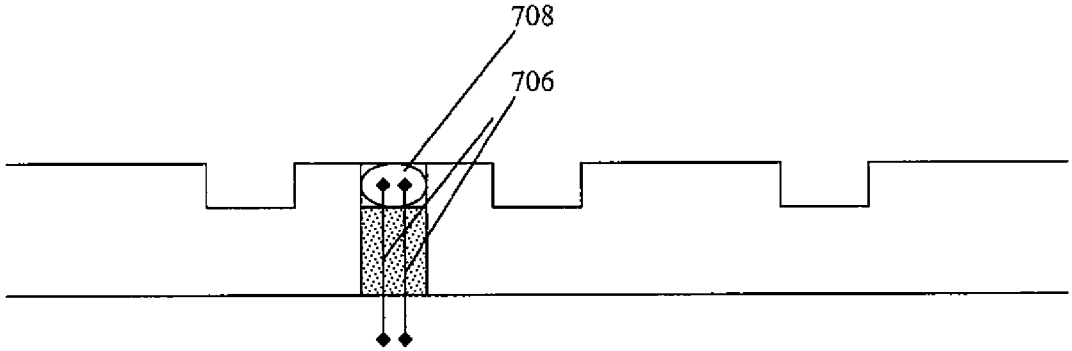
FIG. 7B shows the electrochemical sensor of FIG. 7A exposed as a result of pad wear.

In further embodiments of the present invention, the end-of-life sensor may be an electrochemical sensor containing two or more probes embedded in the pad at a predetermined depth or depths from the top surface of the pad when new. An example of such a configuration is shown in FIG. 7A, which illustrates an electrochemical sensor 702 positioned below a surface of a new pad 704. As the pad wears, exposing the probes, slurry provides electrical connectivity between the probes, and resulting electrical signal paths formed thereby can be used to transmit or transport signals to a detector so as to detect pad wear and, eventually, end of pad life. FIG. 7B shows the electrochemical sensor exposed due to pad wear and probes 706 are connected by the presence of slurry element 708. The continuity in the circuit indicates a certain pad wear has occurred.

Figure 8A:
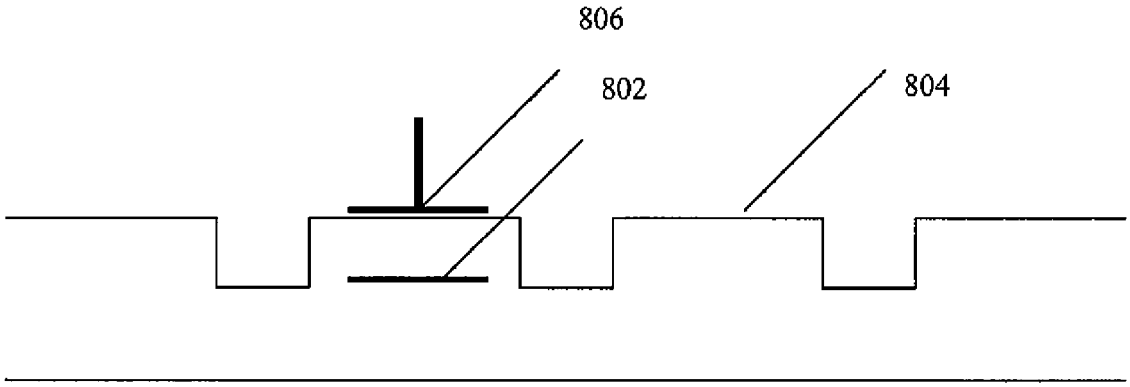
FIG. 8A shows an example of a conductive plate embedded below the surface of a polishing pad in accordance with still a her embodiment of the present invention.
Figure 8B:
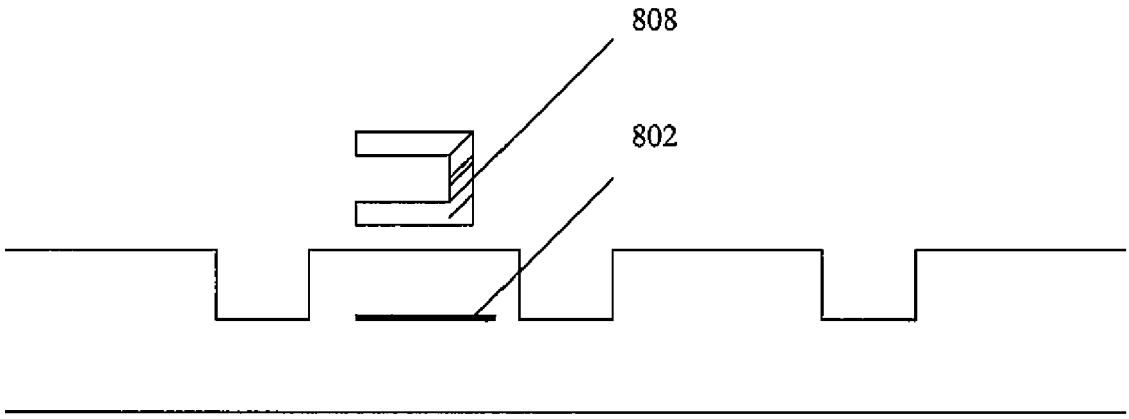
FIG. 8B shows an arrangement with an eddy current sensor held at the top surface of the pad shown in FIG. 8A to assist in determining pad wear in accordance with an embodiment of the present invention.

In still other embodiments of the present invention, the end-of-life sensor may be a conductive plate embedded at a predetermined depth below the surface of a pad when new. An external capacitive or eddy current sensor may be used to detect distance from the conductive plate, hence pad thickness or pad wear. FIG. 8A shows an example of this configuration with conductive plate 802 embedded below the pad surface 804. A capacitive sensor plate 806 is held at the top surface of the pad to determine separation, which is indicative of pad wear. FIG. 8B shows this arrangement with eddy current sensor 808 held at the top surface of the pad to determine separation.

Thus, an improved CMP polishing pad and process for polishing semiconductor wafers and structures layered thereon, including metal damascene structures on such wafers, has been described. Although the present polishing pad and processes for using it have been discussed with reference to certain illustrated examples, it should be remembered that the scope of the present invention should not be limited by such examples. Instead, the true scope of the invention should be measured on in terms of the claims, which follow.

What is claimed is:

1. A polishing pad, comprising: a guide plate having affixed thereto a porous slurry distribution layer on one side and a compressible under-layer on opposite side; and a plurality of polishing elements interdigitated with one another through the slurry distribution layer and the guide plate so as to be maintained in planar orientation with respect to one other and the guide plate, each polishing element being affixed to the compressible under-layer and protruding above a surface of the guide plate to which the slurry distribution layer is adjacent.

2. The polishing pad of claim 1, further comprising a membrane positioned between the guide plate and the slurry distribution layer.

3. The polishing pad of claim 2, wherein the membrane comprises a conductive membrane.

4. The polishing pad of claim 2, wherein the membrane comprises a non-conductive membrane.

5. The polishing pad of claim 2, wherein the membrane is fastened to the guide plate by an adhesive.

6. The polishing pad of claim 2, wherein the membrane comprises an ion exchange membrane.

7. The polishing pad of claim 1, wherein the guide plate is made of a non-conducting material.

8. The polishing pad of claim 1, wherein at least some of the polishing elements have circular cross sections.

9. The polishing pad of claim 1, wherein at least some of the polishing elements have triangular cross sections.

10. The polishing pad of claim 1, wherein the polishing elements are made from any one or combination of: a thermally conducting material, an electrically conducting material, or a non-conducting material.

11. The polishing pad of claim 10, wherein the polishing elements are made of one of: a conductive polymer polyaniline, carbon, graphite, or metal-filled polymer.

12. The polishing pad of claim 1, wherein one or more of the polishing elements are fashioned so as to make sliding contact with a wafer surface.

13. The polishing pad of claim 1, wherein one or more of the polishing elements are fashioned so as to make rolling contact with a wafer surface.

14. The polishing pad of claim 13, wherein the one or more of the polishing elements fashioned so as to make rolling contact with a wafer surface has a cylindrical body and a rolling tip.

15. The polishing pad of claim 14, wherein the rolling tips of the one or more of the polishing elements are made of one of the following materials: a polymeric, metal oxide, or electrically conducting material.

16. The polishing pad of claim 1, wherein the slurry distribution material includes a number of slurry flow resistant elements.

17. The polishing pad of claim 16, wherein the slurry distribution material has between 10 and 90 percent porosity.

18. The polishing pad of claim 1, wherein the slurry distribution material is fastened to the guide plate by an adhesive.

19. The polishing pad of claim 1, wherein the slurry distribution material includes multiple layers of different materials.

20. The polishing pad of claim 19, wherein the slurry distribution material comprises a surface layer having relatively large pores and a lower layer having relatively small pores.

21. The polishing pad of claim 1, further comprising a housing configured to at least partially peripherally contain the guide plate, the polishing elements, and the slurry distribution material therein.

22. The polishing pad of claim 1, wherein the polishing pad has a thickness of between 3 and 10 millimeters.

23. The polishing pad of claim 1, wherein the compressible under-layer is formed of a foam or resilient polymer configured to provide a positive pressure directed toward a polishing surface of the polishing pad when compressed.

24. The polishing pad of claim 1, wherein the polishing elements are distributed across a face of the polishing pad such that collectively the polishing elements have a density of between 30 to 80 percent of a total polishing pad surface area.

25. The polishing pad of claim 1, further comprising a pad wear sensor embedded at a depth from a top surface of the pad as measured from a working end of one or more of the polishing elements.

26. The polishing pad of claim 25, wherein the pad wear sensor comprises an optically transparent plug having a top surface covered with reflective coating.

27. The polishing pad of claim 25, wherein the pad wear sensor comprises a number of optically transparent plugs embedded to different depths within the pad.

28. The polishing pad of claim 25, wherein the pad wear sensor comprises an optically transparent conical plug mounted flush with the top surface of the pad surface.

29. The polishing pad of claim 25, wherein the pad wear sensor comprises an optically transparent plug having a multi-step surface configured to be exposed to varying degrees as the pad wears.

30. The polishing pad of claim 25, wherein the pad wear sensor comprises an optically transparent plug containing screens with varying degrees of transmission arranged in order of reflectivity.

31. The polishing pad of claim 25, wherein the pad wear sensor comprises an electrochemical sensor containing two or more probes embedded in the pad.

32. The polishing pad of claim 25, wherein the pad wear sensor comprises a conductive plate embedded at a depth below the surface of the pad.

* * * * *